US005799941A

United States Patent [19]

Panneton

[11] Patent Number: 5,799,941

[45] Date of Patent: Sep. 1, 1998

[54] BOARD GAME HAVING MULTIPLE, INTERCONNECTING SEGMENTS

[76] Inventor: Steev Panneton, 358 Washington St., West Warwick, R.I. 02893

[21] Appl. No.: 861,872

[22] Filed: May 22, 1997

[51] Int. Cl.[6] ..... A63F 3/00

[52] U.S. Cl. ..... 273/246

[58] Field of Search ..... 273/246, 248, 273/249, 274, 275, 283, 284

[56] References Cited

U.S. PATENT DOCUMENTS

| | | | |
|---|---|---|---|
| 3,231,279 | 1/1966 | Howarth et al. | 273/246 |
| 3,462,152 | 8/1969 | Royston | 273/246 |
| 3,829,098 | 8/1974 | Umminger, Jr. . | |
| 3,889,954 | 6/1975 | Malisow . | |
| 3,927,886 | 12/1975 | Day . | |
| 4,052,072 | 10/1977 | Beal . | |
| 4,317,570 | 3/1982 | Brunton | 273/246 |
| 4,484,749 | 11/1984 | Charney . | |
| 4,569,527 | 2/1986 | Rosenwinkel et al. . | |
| 4,614,344 | 9/1986 | O'Connor . | |
| 4,746,126 | 5/1988 | Angileri . | |
| 4,902,019 | 2/1990 | Berman . | |
| 4,921,249 | 5/1990 | Kropkowski et al. | 273/274 |
| 4,930,789 | 6/1990 | Harris et al. . | |
| 5,002,283 | 3/1991 | Langham et al. . | |
| 5,048,840 | 9/1991 | Johnson, Jr. . | |
| 5,092,605 | 3/1992 | Hoffman . | |
| 5,188,364 | 2/1993 | Falzarano . | |
| 5,226,655 | 7/1993 | RicKabaugh . | |
| 5,228,698 | 7/1993 | Dubarry, Jr. . | |
| 5,350,178 | 9/1994 | Hollar | 273/246 |
| 5,362,064 | 11/1994 | Lofink et al. . | |
| 5,405,147 | 4/1995 | Garcia . | |
| 5,551,698 | 9/1996 | Lyon | 273/246 |

FOREIGN PATENT DOCUMENTS

| | | |
|---|---|---|
| 1013382 | 5/1977 | Canada . |
| 966237 | 12/1964 | United Kingdom . |
| 1348632 | 2/1970 | United Kingdom . |

*Primary Examiner*—William E. Stoll
*Attorney, Agent, or Firm*—Salter & Michaelson

[57] ABSTRACT

A board game, which is played by at least two players, includes a movement piece for each player and at least one random movement device capable of generating a random number for determining the magnitude of movement of the movement pieces. A racing segment has a plurality of lanes, each lane having a plurality of spaces with a first group of movement icons provided thereon for indicating a type of movement to be performed by the movement pieces upon landing on the space. A gaming segment has a plurality of lanes, each lane having a plurality of spaces with a game icon thereon. The arrangement is such that upon landing on a space having a certain game icon, a player must successfully play a game indicated by the game icon prior to moving off of the space. A maze segment has one lane with a plurality of spaces, each space having a second group of movement icons thereon for indicating a type of movement of the movement pieces. The movement pieces move along the spaces of the lanes of the racing, gaming and maze segments a number of spaces as determined by the random movement device. Snap fitting connections are provided for selectively and releasably interconnecting the racing, gaming and maze segments to one another for altering the overall nature of the game and the length of the game.

19 Claims, 6 Drawing Sheets

BOARD GAME HAVING MULTIPLE, INTERCONNECTING SEGMENTS

BACKGROUND OF THE INVENTION

The instant invention relates generally to board games, and more particularly to a board game that incorporates the competitiveness associated with games requiring each participant to move from a starting point to a finishing point, along with the risk of betting-type games.

Board games are well-known in the games art. In this regard, the U.S. Pat. Nos. 3,829,098 to Umminger, Jr.; 3,889,954 to Malisow; 3,927,886 to Day; 4,052,072 to Beal; 4,484,749 to Charney; 4,569,527 to Rosenwinkel et al.; 4,614,344 to O'Connor; 4,746,126 to Angileri; 4,902,019 to Berman; 4,930,789 to Harris et al.; 5,002,283 to Langham et al.; 5,048,840 to Johnson, Jr.; 5,092,605 to Hoffman; 5,188,364 to Falzarano; 5,226,655 to Rickabaugh; 5,228,698 to Dubarry, Jr.; 5,362,064 to Lofink et al.; and 5,405,147 to Garcia, along with Canadian Patent No. 1,013,382 and Great Britain Patent Nos. 966,237 and 1,348,632, are representative of various prior art in this area.

The U.S. Patents to O'Connor, Falzarano and Garcia each disclose a board game having interchangeable parts or segments for changing the overall nature of the game and/or the length of the game. In particular, Falzarano discloses a game having a number of track-like parts which fit together to form the board game. However, the games disclosed in these particular references lack the risk and danger associated with betting-type games, such as blackjack, craps, roulette and slots.

A number of the foregoing patents, such as the U.S. Patents to Malisow, Day, Angileri, Berman and Harris et al. disclose the general concept of incorporating a betting-type game into a board game. However, these board games are not very versatile in that the length of the game and its overall nature cannot be altered by adding or subtracting portions of the game while maintaining the continuity of the game.

There is presently a need for a board game that combines the competitiveness of conventional start/finish board games, the versatility of games that are capable of being altered to change the length of the game and its overall nature, along with the risk of betting-type games.

The foregoing illustrates limitations known to exist in present games. Thus, it is apparent that it would be advantageous to provide an improved game directed to overcoming one or more of the limitations set forth above. Accordingly, a suitable alternative is provided including features more fully disclosed hereinafter.

SUMMARY OF THE INVENTION

The instant invention provides a board game which is played by at least two players, the board game comprising a movement piece for each player and at least one random movement device capable of generating a random number for determining the magnitude of movement of the movement pieces. The game further comprises a "racing" segment having a plurality of lanes, each lane having a plurality of spaces with first movement icons provided thereon for indicating a type of movement to be performed by the movement pieces upon landing on the space. A "gaming" segment has a plurality of lanes, each lane having a plurality of spaces with game icons thereon. The arrangement is such that upon landing on a space having a certain game icon, a player must successfully play a game indicated by the game icon prior to moving off of the space. A "maze" segment has one lane with a plurality of spaces, each space having second movement icons for indicating a type of movement of the movement pieces. The movement pieces move along the spaces of the lanes of the racing, gaming and maze segments a number of spaces as determined by the random movement device.

More specifically, the first movement icons of the spaces of the lanes of the racing segment are selected from a group comprising: a first pit stop block entitling the player to extra play fuel; a second pit stop block in which the player does not receive play fuel; a fuel consumption block in which the player loses play fuel; a siphon block in which a player can siphon play fuel from an opposing player; a breakdown block in which the player loses a turn; a power booster block in which the player advances a predetermined number of spaces along the lane; an oil slick block; and a detour block in which the direction of the player's next turn is selected. The game icons of the spaces of the lanes of the gaming segment are selected from a group comprising: craps, roulette, high cut and slots. Finally, the movement icons of the spaces of the lanes of the maze segment are selected from a group comprising: an over heat block in which the player loses a turn; a ditch block in which the player advances a reduced amount as determined by the random movement device; and a barricade block which, upon obtaining a predetermined number with the random movement device, entitles the player to construct a roadblock on a space of the lane of the maze segment for blocking other players in that lane.

Also, the board game of the present invention further includes interconnecting means for selectively and releasably interconnecting the racing, gaming and maze segments to one another for altering the overall nature of the game and the length of the game. The interconnecting means comprises, for each segment, a snap fitting member extending from the segment wherein the snap fitting member is received in a corresponding recess formed in the adjacent segment for releasably attaching adjacent segments to one another.

A method of game play is further disclosed.

Accordingly, among the objects of the instant invention are: the provision of an improved board game having a plurality of segments which may be selectively interconnected for changing the overall nature and length of the board game; the provision of such an improved board game which has a gaming segment directed to betting-type games, such as blackjack, craps, roulette and slots; the provision of such an improved board game which can be played by children and adults alike; and the provision of such an improved board game which is easy and fun to play.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
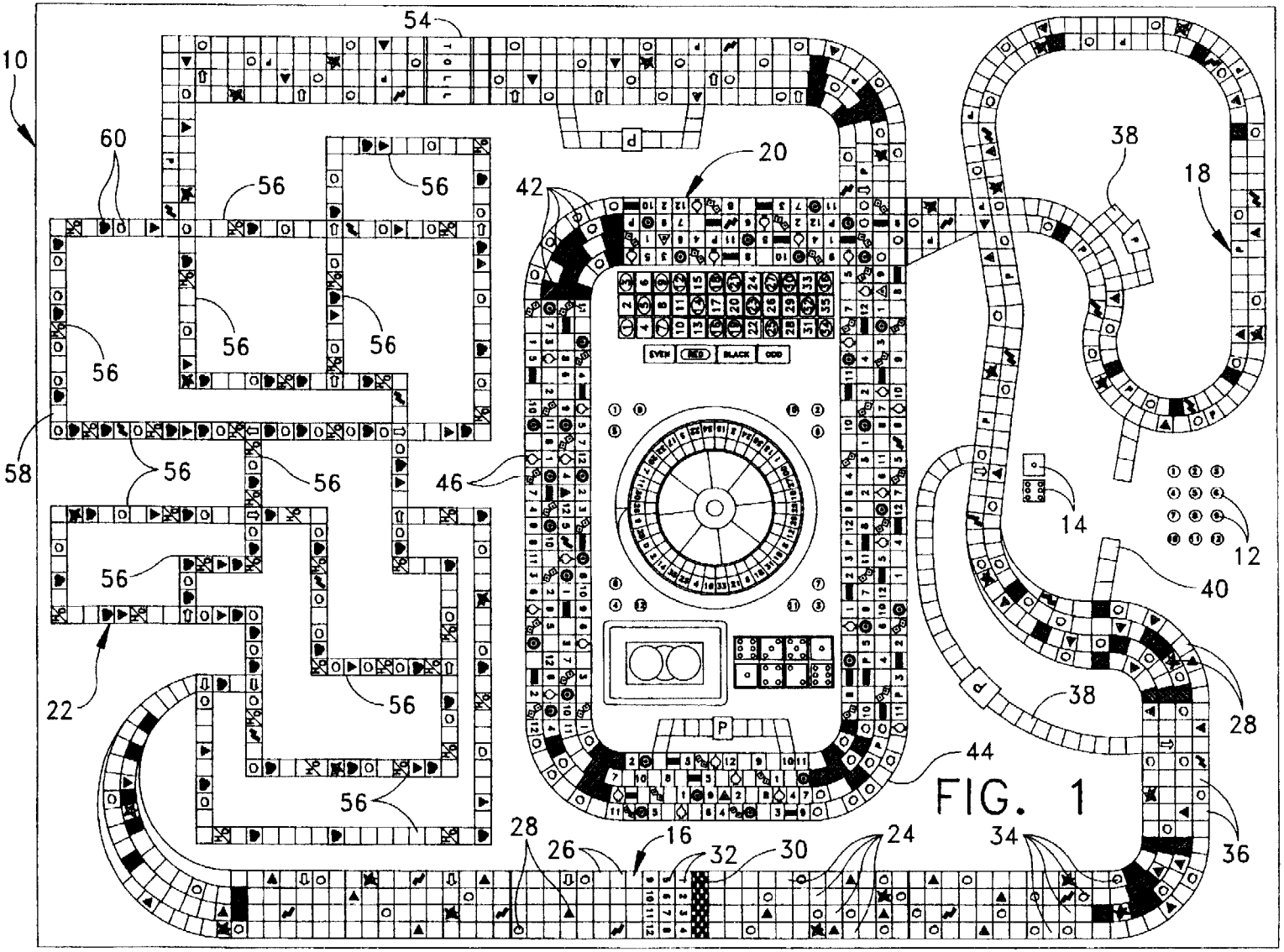
FIG. 1 is a top plan view of a board game of the present invention.

Referring now to the drawings, and more particularly to FIG. 1, there is generally indicated at 10 a board game constructed and arranged according to the principles of the present invention. As shown, the board game 10 is relatively detailed in construction and appearance and includes a plurality of different segments or sections which enable players of the game 10 to selectively assemble it to meet their particular needs or duration requirements. The board game 10 is fun to play in that it incorporates the competitiveness and excitement of start/finish-type board games with the risk of betting-type games. Furthermore, it can be played by children and adults alike, thereby providing widespread appeal notwithstanding the ages of the players.

As illustrated in FIG. 1, the board game 10 comprises twelve tokens or movement pieces, each indicated at 12, which are numbered from one (1) to twelve (12). This enables twelve persons to play the game at once, although less people can certainly play if desired. Also provided is a random movement device embodying dice 14 which, when rolled, determine the magnitude of movement of the tokens. In the illustrated embodiment of the invention, dice 14 are provided for determining magnitude of movement; however, it should be noted that any other suitable random movement pieces, such as dominoes, tokens, cards, or the like, can be used instead of dice 14 and still fall within the scope of the present invention. Dice 14 are provided because they are readily available, easy to use and enable the game to move along relatively quickly.

As shown, the board game 10 comprises four main segments, namely, a start/finish segment, generally indicated at 16, a "racing" segment, generally indicated at 18, a "gaming" segment, generally indicated at 20, and a "maze" segment, generally indicated at 22. These segments are separate and apart from one another thereby enabling the players to selectively assemble the board game 10 so that favorite segments are played, or that only one or two segments are played for reducing the amount of time needed to play a complete game. The racing segment 18 and the maze segment 22 offer the competitiveness and excitement exhibited by start/finish games, whereas the gaming segment 20 includes betting-type games, such as roulette, blackjack, slots and craps, which are commonly enjoyed.

Figure 3:
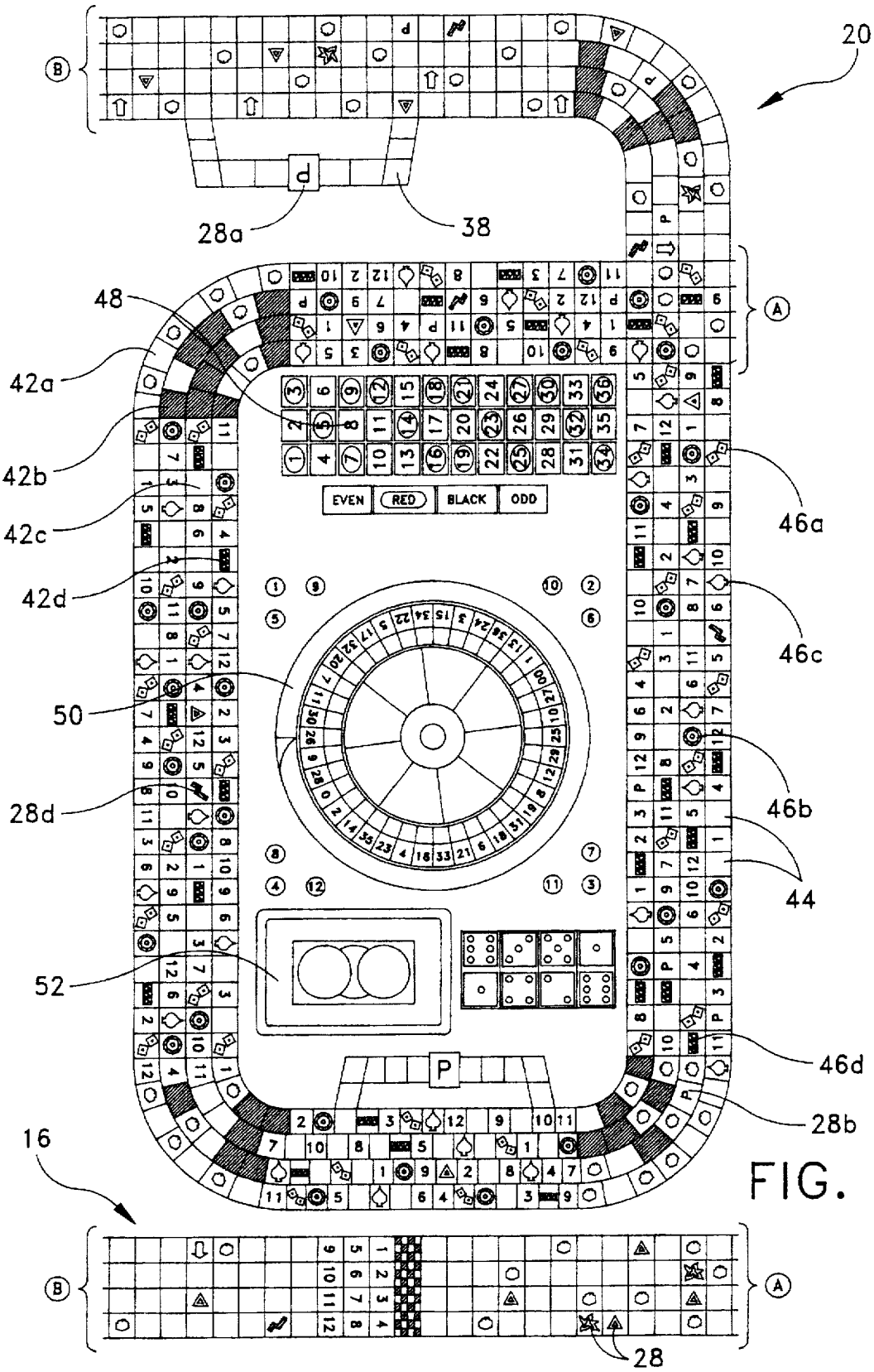
FIG. 3 is a top plan view of a "gaming" segment and a start/finish segment of the board game.

Turning now to FIGS. 1 and 3, the start/finish segment 16 is straight-lined in construction, having four lanes 24*a*, 24*b*, 24*c*, and 24*d* which run parallel to one another in side-by-side relation. Each lane 24 includes a plurality of equal-sized spaces, each indicated at 26, some of which have imprinted thereon first movement icons 28 which have specific meanings that will be described in greater detail below. There is a start/finish line 30 which is adjacent to twelve starting positions 32. The twelve starting positions 32 are numbered in such a manner that the first four starting position (i.e., Nos. 1–4) are next to the start/finish line 30. The next four starting positions 32 (i.e., Nos. 5–8) are behind the first four, and the last four starting positions 32 (i.e., Nos. 9–12) are behind them. The game begins by each player rolling a single die to determine the token number and the starting position. More specifically, each player rolls a single die and the player with the highest roll gets the No. 1 starting position. The player with the next higher roll gets the No. 2 starting position, and so on. Ties between players are settled by each player rolling a single die until one player rolls a higher number. At the beginning of the game, each player is allocated an initial number of gallons of play fuel. The addition and consumption of the play fuel is described in detail below.

Figure 2:
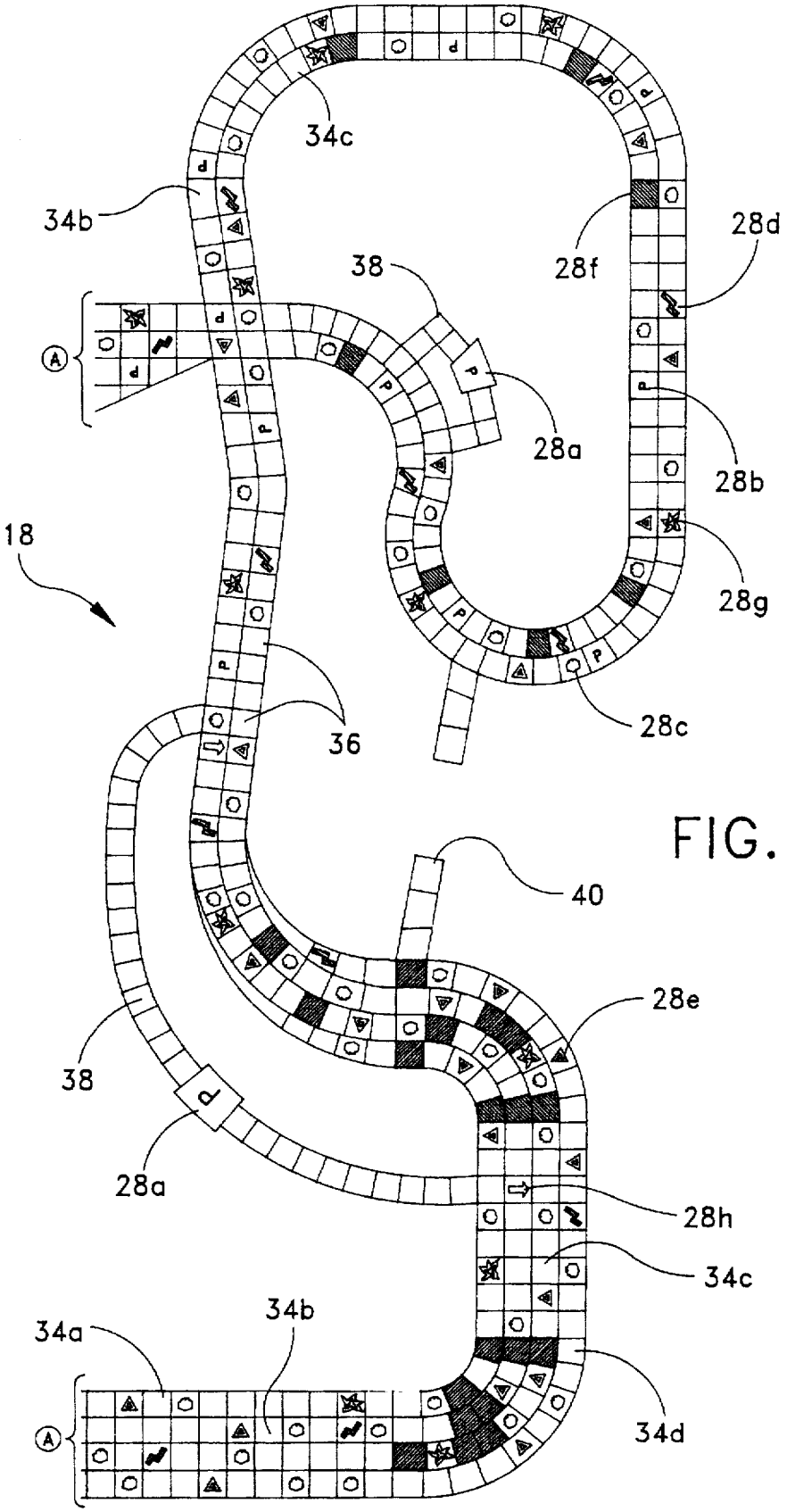
FIG. 2 is a top plan view of a "racing" segment of the board game.
Figure 5:
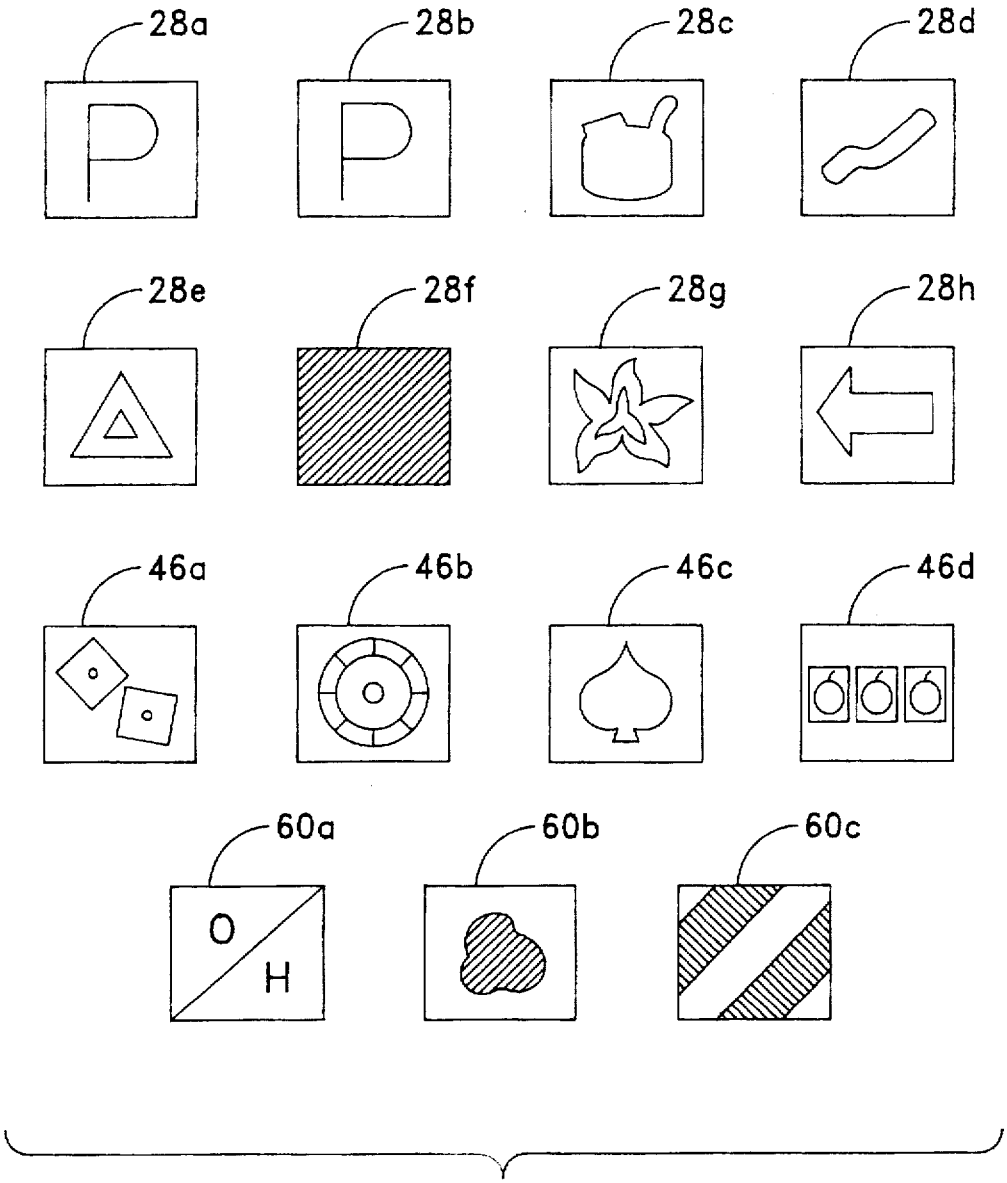
FIG. 5 is a view illustrating various icons depicted on the board game.

Turning now to FIGS. 2 and 5, the racing segment 18 includes a plurality of lanes, 34*a*, 34*b*, 34*c*, and 34*d* which run along each other in side-by-side relation. Each lane 34 comprises a plurality of equal-sized spaces 36, some of which having the first movement icons 28 imprinted thereon. As shown, at the beginning of the racing segment 18, there are four lanes, 34*a*, 34*b*, 34*c*, and 34*d* which are aligned with the four lanes 24*a*, 24*b*, 24*c*, and 24*d* of the start/finish segment 16 when assembled together. The four lanes, 34*a*–34*d* eventually taper down to two lanes, 34*b*, 34*c*. The game begins by the first player in the No. 1 position rolling the dice 14 and moving his or her token 12 the number of spaces as determined by the dice. Players can move forward along their lane, and can actually switch lanes so long as no other player is occupying the lane at the location where the switch is made. Upon landing on a first movement icon 28, the player must move in accordance with the rules provided for that icon. Such rules will be discussed in greater detail below.

Referring particularly to FIG. 5, the first movement icons includes eight separate and distinct icons. Reference number 28*a* designates a first pit stop block which entitles the player to extra play fuel. This pit stop icon 28*a* is depicted by a large letter "P". When a player rolls a number sufficient to reach the first pit stop block 28*a*, that player must roll a single die which determines how many gallons of play fuel awarded to the player. A player must stop at the first pit stop block, regardless of the role. As shown, there are two pit areas 38, each having a first pit stop block 28*a*, for the racing segment 18. It should be noted that stopping at the pit area 38 for play fuel is not mandatory; however, it may be necessary since if a player runs out of fuel, he or she must move back ten (10) spaces in the lane occupied unless a lane change is required. When moving backwards, all obstacles are ignored and the player receives one (1) gallon of play fuel to proceed. A player does not need an exact roll to obtain play fuel from the first pit stop block 28*a*; however, an exact roll entitles the player to an extra gallon of fuel besides the roll allotment. When a player has received the play fuel, he or she must wait until their next turn to continue, unless the player rolled an exact number to be on the first pit stop block 28*a* and rolled a six (6).

The first movement icons 28 further include a second pit stop block 28*b*, which, when a player lands thereon, does not entitle the player to play fuel. In fact, when landed on, the player must return backwards to the nearest pit area 38. This icon 28*b* is depicted also with a large letter "P", but shaded differently than the first pit stop block.

A fuel consumption block 28*c* is further provided with the first movement icons 28. As illustrated in FIG. 5, this icon 28*c* is depicted by a fuel canister. With this block 28*c*, when landed on, the player loses a certain predetermined amount of play fuel, e.g., one (1) gallon.

The next icon is a siphon block 28*d*, in which a player can siphon play fuel from an opposing player. More particularly, a player, for any reason, can siphon half of any opponent's play fuel who is on an adjacent block. If the opponent's play fuel level is an odd amount (e.g., five (5) gallons), the player takes the largest half (e.g., three (3) gallons), thereby leaving the opponent with the smaller half of play fuel. The siphon block 28*d* is depicted by a hose in FIG. 5.

The first group of movement icons 28 further include a breakdown block 28*e* and an oil slick block 28*f*. The breakdown block 28*e* is depicted by the traditional red triangle whereas the oil slick block 28*f* is depicted by a black box. The breakdown block 28*e*, when landed upon by a player, results in that player losing a turn. The oil slick block 28*f* forces the player landing thereon into the outside lanes 24*a*, 24*d* for as long as the oil slick lasts. When an oil slick block 28*f* forces a player into a block already occupied by an opponent, only then may the two players occupy the same block wherein both players lose a turn.

Icon 28*g*, which is a blue and white flame, depicts a power booster block in which the player advances a predetermined number of spaces 26 along the lane (e.g., five spaces).

Finally, the first group of movement icons 28 also comprises a detour block 28*h* which is depicted by an arrow in FIG. 5. When landed on, this block 28*h* indicates the direction of the player's next move. The player must continue in this direction until an outside block or an intersection is reached. At this point, the player may then change directions if desired.

The racing segment also includes a by-pass section 40 which cuts off a major portion of the racing segment 18; however, at a certain risk. More specifically, a player attempting the by-pass section 40 must move to the last space 26 of the section and, on his or her next roll of the dice 14, achieve a roll of twelve (12) with the dice in order to make the "jump" to the space 26 on the other side of the section 40. This roll of twelve (12) can only be used from the last space 26 of the section, and cannot be used from preceding spaces 26. It should be noted that any number can be chosen to utilize the by-pass section 40, and that the numbers two (2) or twelve (12) are more difficult to achieve than numbers therebetween.

Referring back to FIGS. 1 and 3, the gaming segment 20 also has four lanes 42*a*, 42*b*, 42*c* and 42*d* which a player must travel when moving his or her token 12 through the gaming segment 20. In this regard, like the racing segment 18, each lane 42*a*42*d* of the gaming segment 20 also includes spaces 44, each of which having imprinted thereon a game icon 46 chosen from a group of game icons. The game icons 46*a*, 46*b*, 46*c* and 46*d* designate the betting-type games of craps, roulette, high cut and slots, respectively. The arrangement is such that upon first entering the gaming segment 20 of the board game 10, the player must successfully play a game of blackjack in order to proceed any further. Blackjack is a common card game which is well-known to gamblers and non-gamblers alike. For this board game 10, the house or opponent is always dealt to first the house cards are dealt face up and the player's and/or opponent's first two cards are dealt face down with the remaining cards being dealt face up. The object is to achieve a higher score than the house without going over twenty-one (21). Since blackjack is so well-known in the art, no further description is required. When a player wins, he or she may roll the dice 14 and move. If a player loses, he or she must wait until their next turn and play blackjack again until successful.

As illustrated best in FIG. 3, there are spaces 44 of the gaming segment 20 having numbers imprinted thereon. As described above, each player at the beginning of the game was assigned a number. A player landing on his or her own number relieves that player of all gambling rules provided for in the gaming segment 20. Stated another way, the player landing on his or her assigned number does not have to gamble in order to move when it is that player's next turn. A player can opt to play one of the aforementioned gambling games when landing on his or her own number, and if the player wins, that player can double the amount rolled on the dice. Otherwise, if the player loses, that player forfeits his or her next turn. If a player lands on an opponent's space, the opponent is allowed to choose the game to be played. In addition, when it is the player's turn to move, he or she must play that opponent at the game of their choice, after which the winner may then move.

While in the gaming segment 20 of the board game 10, any roll of the dice 14 intended as a means of movement of players' tokens 12 will automatically move the tokens the number coinciding with that rolled on the dice. Each player can change lanes throughout the entire segment 20 and must oblige all obstacles.

As briefly described above, there are separate icons for designating craps, roulette, high cut and slots. In FIG. 5, Reference No. 46*a* designates craps, there being a pair of dice shown on the icon. The roulette space 46*b* is represented by a roulette wheel. The spaces 46*c*, 46*d* assigned for high cut and slots, respectively, are represented by a spade symbol and three slot machine indicia (e.g., cherries), respectively. As with blackjack, each of these games are so well known in the art of gaming that they require no further explanation other than the brief explanations given below. It should also be noted that several of the first movement icons 28 can be included with the game icons 46.

Craps is played with two dice. The player's chances of rolling a seven (7) are greater than rolling any other number (i.e., 2–6 and 8–12). If a player rolls a seven or eleven on the first roll (sometimes called a "natural"), that player wins. At this point the player rolls the dice to determine the amount the player moves. If a player rolls a two (2), three (3) or twelve (12) on the first roll, that player craps out and loses. At this point the player must wait to the next turn and replay the game again. Finally, if a player rolls a four (4), five (5), six (6), eight (8), nine (9), or ten (10), that player must then continue to roll until the prior number is matched, which entitles the player to roll again and move the token, or until they roll a seven and crap out.

Roulette is played by placing a bet on a betting area 48 of the gaming segment 20 of the board game 10, spinning a roulette wheel 50 secured to the gaming segment 20 of the board game, and rolling a ball (not shown) thereon. When the ball rests on a number, the player determines if it coincides with the bet. If so, the player wins and can move on, whereas if the player loses, he or she must wait until their next turn. There are three bets a player can make, namely, a straight up bet, a street bet, and a red, black, odd or even bet. When a player bets on one number, this is considered a straight bet. If the player wins, he or she is entitled to double the amount on the dice when moving. A street bet is made by betting on three consecutive numbers across the betting table, the winner of this bet entitling that player to double the amount on the dice when moving. If a player bets red, black, odd or even, and wins, that player is entitled to move an amount corresponding to the amount showing on the rolled dice. A player who rolls zero (0) or double zeros (00) must go back five (5) spaces and oblige all obstacles. All other bets loose.

High cut is played by cutting a deck of cards 52 randomly wherein the person who has the highest card number, after cutting the deck, wins. When playing the house, the house's card is cut first. When playing an opponent, the opponent's card is first cut. A player must beat either the house or his opponent in order to advance his or her token 12.

The last betting-type game of instant invention is slots, which is indicated by the icon 46*d*. In this game, three dice are utilized, wherein if a player rolls the same number with two out of three of the dice, that player wins. In this case, the player may roll two dice and move his or her token with another roll of the dice. When all three numbers match, the player is awarded twice the amount rolled on the movement roll of the dice. Three sixes entitle the player to twice the amount rolled on the movement roll and two gallons of play fuel.

When leaving the gaming segment 20 of the board game 10, the player must pass through a toll 54 which is illustrated in FIG. 1. Each player must stop at the toll 54 and roll the dice 14. The player must roll their entry number to pay the toll and continue. In order to even out the odds, Player No. 1 gets one roll with one die, Player Nos. 2, 3, 11 and 12 get three rolls with two dice, Player Nos. 4, 5, 9 and 10 get two rolls with two dice, and Player Nos. 6, 7 and 8 get one roll with two dice. Once a player rolls his or her number, that player can proceed to the maze segment 22 of the board game 10.

Figure 4:
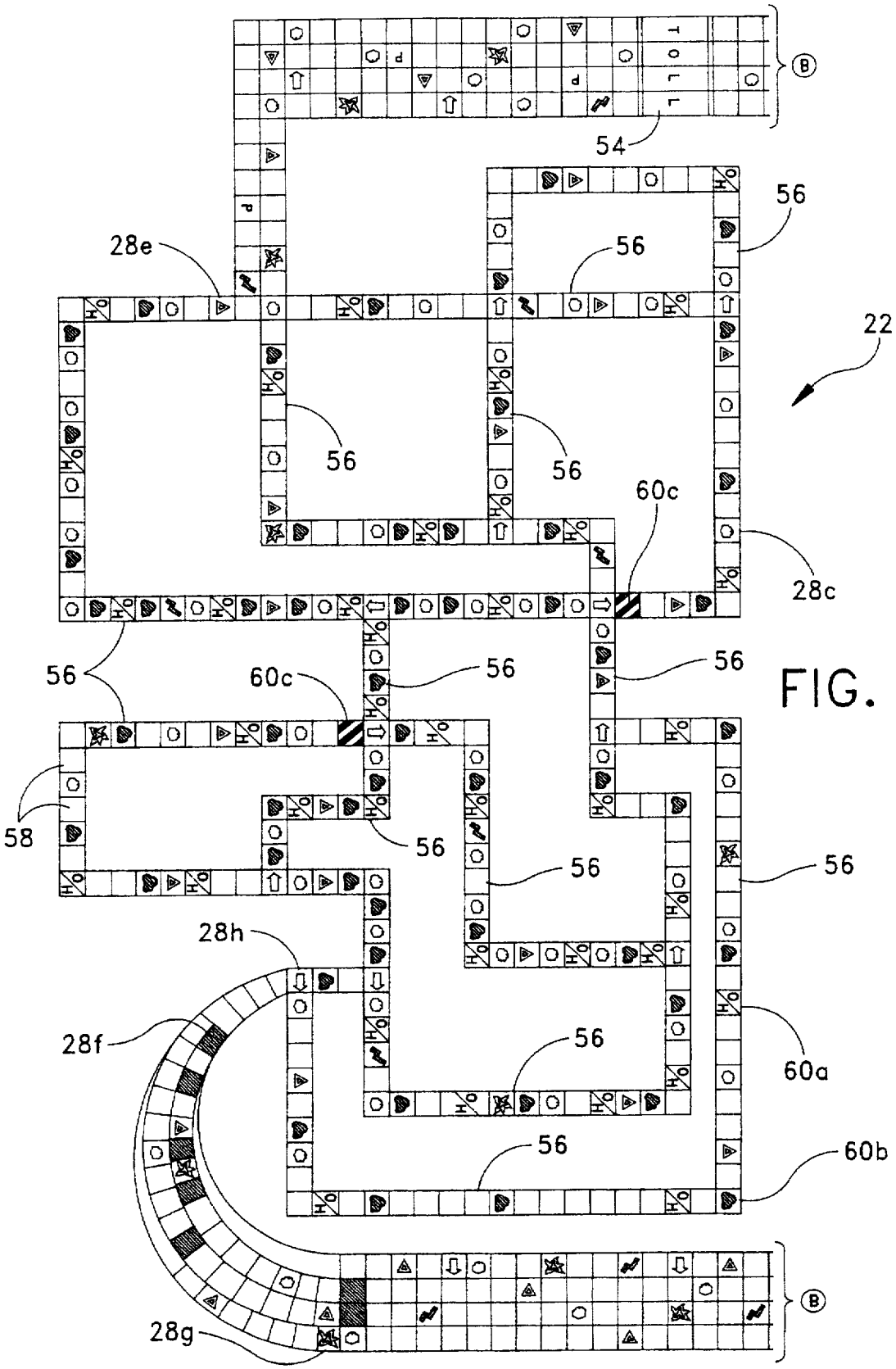
FIG. 4 is a top plan view of a "maze" segment of the board game.

Turning now to FIGS. 1, 4 and 5, the last segment of the board game 10 is the maze segment 22. This segment 22 requires the player to choose a path of direction in order to proceed to the finish/start segment 16 where the game ends. The maze segment 22 includes a plurality of one-lane paths 56, each path having spaces 58 with a group of second movement icons 60 imprinted thereon. The paths 56 having the least amount of spaces 58 between a starting space of the maze segment and a finishing space thereof have the greatest amount of icons 60, whereas the paths 56 having more spaces between the starting and finishing spaces have a lesser amount of icons. Thus, there is a risk/reward factor when choosing which path 56 to follow.

There are three icons 60*a*, 60*b*, and 60*c* of the second group of movement icons 60. The first 60*a* is an over heat block in which the player who lands thereon loses a turn. Another is a ditch block 60*b* in which the player advances a number of spaces equaling the lowest number of the two numbers rolled by the dice. The last icon is a barricade block 60*c* which, upon obtaining a predetermined number with the dice 14, entitles the player to construct a roadblock on a space 58 of a path 56 of the maze segment 22 for blocking other players in that path 56. For example, a roll of twelve (12) entitles a player to construct a barricade to deter that player's opponents. The cost of putting up a barricade is one gallon of play fuel. An opponent can remove a barricade by rolling a predetermined number (e.g., twelve (12)), wherein that opponent can keep the barricade for future use. Players may also trade-in barricades for one gallon of play fuel, but only while the player trading is in the maze segment 22 of the board game 10.

After completing the maze segment 22 of the board game 10, the players advance to the start/finish segment 16 to end the game. A player must cross the start/finish line 30 by rolling an exact number to just cross the line.

Figure 6:
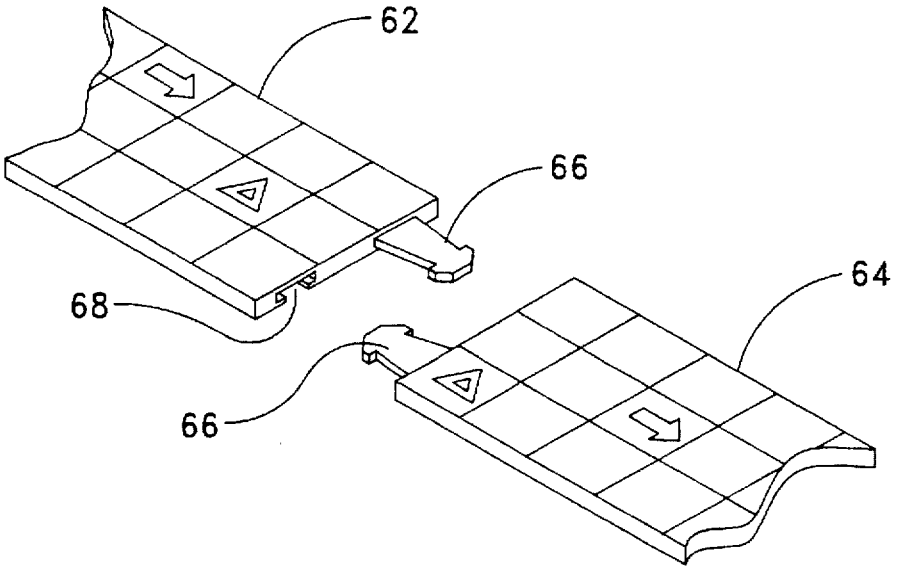
FIG. 6 is an enlarged perspective view of connectors used to releasably connect pieces of the segments to one another.

Referring to FIG. 6, there is illustrated therein the manner in which the start/finish 16, racing 18, gaming 20 and maze segments 22 are selectively and releasably connected to one another. As discussed above, prior to starting a game, the board game 10 can be arranged in any number of configurations other than the configuration illustrated in FIG. 1 in order to alter the game to the players' specifications or lengthen or shorten the game. As shown, each segment includes a plurality of pieces 62, 64, each of which has an outwardly projecting snap fitting member 66 extending from the piece. The snap fitting members 66 are received in corresponding recesses 68 formed in an adjacent piece 62 or 64 for attaching the pieces to one another. Although there are snap fitting members 66 illustrated in FIG. 6, it should be understood that any releasable connecting means can be utilized and still fall within the scope of the present invention. The segments 18, 20, 22 and 24 can be divided into any number of pieces which are conveniently sized for fitting within a box or carrying case (not shown).

It can therefore be seen that the instant invention provides a unique and novel game which is fun to play by children and adults alike. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A board game which is played by at least two players, the board game comprising:

a movement piece for each player;

at least one random movement device capable of generating a random number for determining the magnitude of movement of the movement pieces;

a racing segment having a plurality of lanes, each lane having a plurality of spaces, some of said plurality of spaces having a first group of movement icons provided thereon for indicating a type of movement to be performed by the movement pieces upon landing on the space;

a gaming segment having a plurality of lanes, each lane having a plurality of spaces, some of said plurality of spaces having a group of game icons thereon, the arrangement being such that upon landing on a space having a certain game icon, a player must successfully play a game indicated by the game icon prior to moving off of the space; and a maze segment having one lane with a plurality of spaces, some of said plurality of spaces having a second group of movement icons thereon for indicating a type of movement of the movement pieces, wherein said movement pieces move along the spaces of the lanes of the racing, gaming and maze segments a number of spaces as determined by the random movement device.

2. The board game set forth in claim 1, said first group of movement icons of the spaces of the lanes of the racing segment being selected from a group comprising: a first pit stop block entitling the player to extra play fuel; a second pit stop block in which the player does not receive play fuel and loses a turn; a fuel consumption block in which the player loses play fuel; a siphon block in which a player can siphon play fuel from an opposing player; a breakdown block in which the player loses a turn; a power booster block in which the player advances a predetermined number of spaces along the lane; an oil slick block in which the player loses a turn; and a detour block in which the direction of the player's next turn is selected.

3. The board game set forth in claim 2, the racing segment having a by-pass section in which the player must obtain a predetermined number of the random movement device in order to pass through the by-pass section.

4. The board game set forth in claim 1, said random movement device comprising a six-sided die.

5. The board game set forth in claim 1, said group of game icons of the spaces of the lanes of the gaming segment being selected from a group comprising: craps, roulette, high cut and slots.

6. The board game set forth in claim 1, said second group of movement icons of the spaces of the lanes of the maze segment being selected from a group comprising: an over heat block in which the player loses a turn; a ditch block in which the player advances a reduced amount as determined by the random movement device; and a barricade block which, upon obtaining a predetermined number with the random movement device, entitles the player to construct a roadblock on a space of the lane of the maze segment for blocking other players in that lane.

7. The board game set forth in claim 1 further comprising a toll segment between the gaming segment and the maze segment.

8. The board game set forth in claim 1 further comprising interconnecting means for selectively and releasably interconnecting the racing, gaming and maze segments to one another for altering the overall nature of the game and the length of the game.

9. The board game set forth in claim 1, said interconnecting means comprising, for each segment, a snap fitting member extending from the segment, the snap fitting member being received in a corresponding recess formed in the adjacent segment for releasably attaching adjacent segments to one another.

10. The board game set forth in claim 1, the lanes of the racing segment alternating between four and two lanes.

11. A board game which is played by at least two players, the board game comprising:

a movement piece for each player;

at least one random movement device capable of generating a random number for determining the magnitude of movement of the movement pieces;

a racing segment having a plurality of lanes, each lane having a plurality of spaces, some of said plurality of spaces having a first group of movement icons provided thereon for indicating a type of movement to be performed by the movement pieces upon landing on the space;

a gaming segment having a plurality of lanes, each lane having a plurality of spaces, some of said plurality of spaces having a group of game icons thereon, the arrangement being such that upon landing on a space having a certain game icon, a player must successfully play a game indicated by the game icon prior to moving off of the space; and interconnecting means for selectively and releasably interconnecting the racing and gaming segments to one another for altering the overall nature of the game and the length of the game, wherein said movement pieces move along the spaces of the lanes of the racing and gaming segments a number of spaces as determined by the random movement device.

12. The board game set forth in claim 11, said first group of movement icons of the spaces of the lanes of the racing segment being selected from a group comprising: a first pit stop block entitling the player to extra play fuel; a second pit stop block in which the player does not receive play fuel and loses a turn; a fuel consumption block in which the player loses play fuel; a siphon block in which a player can siphon play fuel from an opposing player; a breakdown block in which the player loses a turn; a power booster block in which the player advances a predetermined number of spaces along the lane; an oil slick block in which the player loses a turn; and a detour block in which the direction of the player's next turn is selected.

13. The board game set forth in claim 12, the racing segment having a by-pass section in which the player must obtain a predetermined number of the random movement device in order to pass through the by-pass section.

14. The board game set forth in claim 11, said game icons of the spaces of the lanes of the gaming segment being selected from a group comprising: craps, roulette, high cut and slots.

15. The board game set forth in claim 11 further comprising a maze segment having one lane with a plurality of spaces, some of said plurality of spaces having a second group of movement icons thereon for indicating a type of movement of the movement pieces.

16. The board game set forth in claim 15, said second group of movement icons of the spaces of the lanes of the maze segment being selected from a group comprising: an over heat block in which the player loses a turn; a ditch block in which the player advances a reduced amount as determined by the random movement device; and a barricade block which, upon obtaining a predetermined number with the random movement device, entitles the player to construct a roadblock on a space of the lane of the maze segment for blocking other players in that lane.

17. The board game set forth in claim 16 further comprising a toll segment between the gaming segment and the maze segment.

18. The board game set forth in claim 11, said interconnecting means comprising, for each segment, a snap fitting member extending from the segment, the snap fitting member being received in a corresponding recess formed in the adjacent segment for releasably attaching adjacent segments to one another.

19. A method of game play for at least two players on a board game comprising a movement piece for each player, at least one random movement device capable of generating a random number for determining the magnitude of movement of the movement pieces, and a racing segment having a plurality of lanes, each lane having a plurality of spaces, some of said plurality of spaces having one of a group of movement icons provided thereon for indicating a type of movement to be performed by the movement pieces upon landing on the space, said method comprising the steps of:

(a) assigning a movement piece to each player;

(b) allocating an initial amount of play fuel to each player, the play fuel enabling the movement of the movement piece along the racing segment of the board game;

(c) manipulating the random movement device for determining the magnitude of movement of the movement piece, for each player, along the racing segment of the board game;

(d) moving the movement piece in a direction determined by the movement icon and a magnitude determined by the random movement device;

(e) increasing a player's amount of play fuel upon landing on a movement icon which directs the addition of play fuel; and (f) decreasing a player's amount of play fuel upon landing on a movement icon which directs the subtraction of play fuel.

* * * * *